US007273255B2

(12) United States Patent
Nylander et al.

(10) Patent No.: US 7,273,255 B2
(45) Date of Patent: Sep. 25, 2007

(54) PATIENT CHAIR WITH A VERTICALLY MOVABLE SEAT

(75) Inventors: Pär Nylander, Jönköping (SE); Per Ekelin, Vellinge (SE); Bo Persson, Löddeköpinge (SE)

(73) Assignee: Arjo Hospital Equipment AB (SE)

( * ) Notice: Subject to any disclaimer, the term of this patent is extended or adjusted under 35 U.S.C. 154(b) by 116 days.

(21) Appl. No.: 10/555,585

(22) PCT Filed: May 4, 2004

(86) PCT No.: PCT/SE2004/000675

§ 371 (c)(1),
(2), (4) Date: Nov. 4, 2005

(87) PCT Pub. No.: WO2004/098479

PCT Pub. Date: Nov. 18, 2004

(65) Prior Publication Data

US 2006/0220429 A1 Oct. 5, 2006

(30) Foreign Application Priority Data

May 5, 2003 (SE) ..... 0301293

(51) Int. Cl.
*A61G 5/14* (2006.01)
*A47C 1/00* (2006.01)

(52) U.S. Cl. ..... 297/338; 297/330; 297/337; 297/344.12; 297/DIG. 10

(58) Field of Classification Search ..... 297/330, 297/DIG. 10, 337, 338, 344.12
See application file for complete search history.

(56) References Cited

U.S. PATENT DOCUMENTS 2,572,149 A * 10/1951 Hind et al. ..... 297/DIG. 10 X
3,589,769 A * 6/1971 Bressler ..... 297/330 X
3,629,880 A * 12/1971 van Rhyn ..... 297/DIG. 10 X (Continued)

FOREIGN PATENT DOCUMENTS

DE 198 21 451 A1 11/1998

(Continued)

OTHER PUBLICATIONS

International Search Report dated Aug. 23, 2004 (2 pages).

*Primary Examiner*—Rodney B. White
(74) *Attorney, Agent, or Firm*—Craig A. Fieschko, Esq.; DeWitt Ross & Stevens S.C.

(57) ABSTRACT

A patient chair is provided that includes a chassis with a frame, a seating device intended for a patient and connected to the chassis, and a driving device for moving the seating device relative to the frame in the vertical direction between a lower position and an upper position, wherein in the upper position the seating device and, thus, a patient sitting in it are inclined backwards relative to the lower position. In one implementation, a stand belonging to the chassis extends upwards from the frame, and an element connected to the stand is continuously arched. Means cooperating with each other and positioned on the stand and the seating device are arranged for guiding the seating device along the element in the movement of the seating device between the lower and upper positions, so that the seating device is continuously gradually tilted in the course of its curved movement in the vertical direction.

20 Claims, 3 Drawing Sheets

U.S. PATENT DOCUMENTS 3,964,786 A * 6/1976 Mashuda ..... 297/330
4,054,319 A * 10/1977 Fogg et al. ..... 297/330 X
4,076,304 A * 2/1978 Deucher ..... 297/330 X
4,155,416 A * 5/1979 Ausmus ..... 297/DIG. 10 X
4,249,774 A * 2/1981 Andreasson ..... 297/330 X
4,390,076 A * 6/1983 Wier et al. ..... 297/330 X
4,399,572 A 8/1983 Johansson
4,437,537 A * 3/1984 Ausmus ..... 297/DIG. 10 X
4,456,086 A * 6/1984 Wier et al. ..... 297/DIG. 10 X
4,519,649 A * 5/1985 Tanaka et al. ... 297/DIG. 10 X
4,569,556 A * 2/1986 Pillot ..... 297/DIG. 10 X
4,598,944 A * 7/1986 Meyer et al. .... 297/DIG. 10 X
4,802,542 A * 2/1989 Houston et al. ..... 297/330 X
4,809,804 A * 3/1989 Houston et al. ..... 297/330 X
4,948,156 A * 8/1990 Fortner ..... 297/DIG. 10 X
5,054,852 A * 10/1991 Tholkes ..... 297/DIG. 10 X
5,096,008 A * 3/1992 Mankowski ..... 297/DIG. 10 X
5,108,202 A * 4/1992 Smith ..... 297/330
5,137,102 A * 8/1992 Houston et al. ..... 297/330 X
5,265,689 A * 11/1993 Kauffmann ..... 297/330 X
5,346,280 A * 9/1994 Deumite ..... 297/330
5,484,151 A * 1/1996 Tholkes ..... 297/DIG. 10 X
5,951,105 A * 9/1999 Slettebo ..... 297/338
5,984,338 A * 11/1999 Meyer ..... 297/DIG. 10 X
6,053,519 A * 4/2000 Poindexter et al. ..... 297/DIG. 10 X
6,125,957 A * 10/2000 Kauffmann ..... 297/DIG. 10 X
6,126,186 A 10/2000 Mascari
6,142,568 A * 11/2000 Abelbeck et al. ..... 297/330 X
6,192,533 B1 * 2/2001 Porcheron ..... 297/DIG. 10 X
6,244,662 B1 * 6/2001 Porcheron ..... 297/DIG. 10 X
6,250,717 B1 * 6/2001 Porcheron ..... 297/DIG. 10 X
6,619,681 B2 * 9/2003 Gutierrez ..... 297/DIG. 10 X
6,783,179 B2 * 8/2004 Komura et al. ..... 297/330 X
6,811,220 B2 * 11/2004 Shea et al. ..... 297/330 X
7,077,416 B2 * 7/2006 Duarte ..... 297/330 X

FOREIGN PATENT DOCUMENTS

DE 201 16 111 U1 4/2002

* cited by examiner

PATIENT CHAIR WITH A VERTICALLY MOVABLE SEAT

This application is a national stage filing under 35 U.S.C. § 371 of International Application No. PCT/SE2004/000675, filed on May 4, 2004, which claims priority from Swedish Application No. 0301293-7, filed on May 5, 2003.

TECHNICAL FIELD OF THE INVENTION

The invention relates generally to a patient chair with a vertically movable seat.

PRIOR-ART TECHNIQUE

In nursing and home care, patient chairs are used, whose seat and, in many cases, back are movable as a unit between upper and lower positions. The movability is desirable and frequently a requirement made by carers in order to be able in a fairly comfortable way, without straining their back, to move the patient between the patient chair and, for instance, a bed or a toilet.

A large number of patient chairs which more or less satisfy this requirement are available on the market and are described in the patent literature. Thus, patient chairs are known, which only allow the above described movement in a completely vertical direction. The drawback of these patient chairs is that it is difficult for the carer to take off/put on the patient's trousers, skirt, pants, napkin etc. or take sanitary measures as regards the patient's genitals if the patient is sitting on the patient chair. Other conventional patient chairs allow backward inclination of the seat and back unit and, thus, of the patient, in the course of the movement from the lower to the upper position, which makes it easy to reach the patient's lower garments and genitals. The latter patient chair constructions, however, are complicated and thus expensive to manufacture. For example, they may frequently comprise different hinge and link systems, and different motors, to perform a vertical movement of the seat and back unit as well as a tilting movement of this unit to provide a backward inclination of the patient in the upper position, relative to the position of the patient in the lower position, where the patient is sitting "normal" or "straight" on the patient chair.

OBJECT OF THE INVENTION

An object of the invention is to provide a patient chair which is simple in terms of construction, and thus, can be manufactured at low cost. The patient chair may allow movement of its seat, and possibly also its back, between upper and lower positions, wherein in the upper position the patient may be inclined backwards.

SUMMARY OF THE INVENTION

The object of the invention is achieved by a patient chair having the features in claim 1. Advantageous embodiments are defined in the dependent claims.

According to one embodiment of the present invention, a patient chair may have a simple chassis which allows movement of the seat between upper and lower positions. During movement, the seat, and the patient sitting on the seat, may be automatically, continuously, and gradually inclined, backwards in the movement to the upper position, and forwards in the movement to the lower position. There may be no noticeable change between horizontal and vertical movements. The movements can be made by manual power or by machinery.

BRIEF DESCRIPTION OF THE DRAWINGS

Embodiments of the invention will now be described with reference to the accompanying drawing which, by way of example, illustrate several embodiments of the invention.

DETAILED DESCRIPTION

Figure 1A:
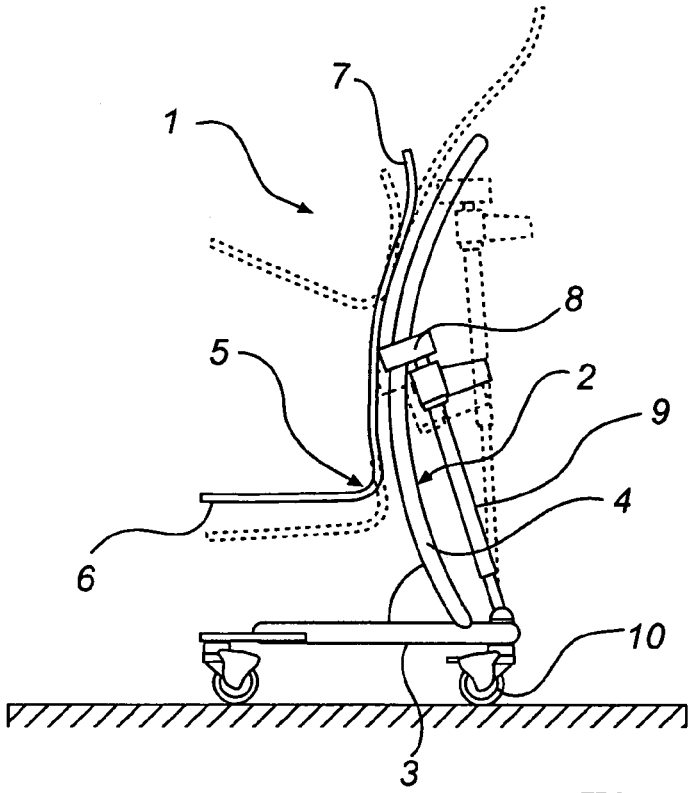
FIG. 1*a* illustrates a side view of a first embodiment of the invention.
Figure 1B:
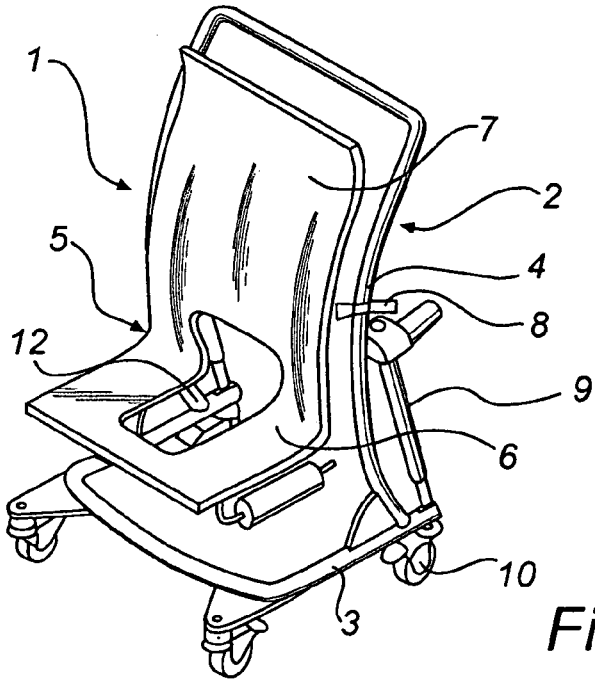
FIG. 1*b* illustrates a perspective view of the first embodiment of the invention.

In FIGS. 1*a, b*, the patient chair 1 includes a chassis 2 with a frame 3 and a vertically arched stand 4. The stand 4 may be connected to a unit 5 consisting of a seat of a chair and a back of a chair 6, 7 by means of a roller bearing arrangement 8 (see FIGS. 2*a, b*), which may be attached to the unit 5 and adapted to roll on the stand 4. To move the unit 5 on the stand 4, there may be a drive unit, in this case a hydraulic cylinder assembly 9, the ends of which may be articulated at suitable points on the chassis 2 and the roller bearing arrangement 8. It is indicated by the dashed lines in FIG. 1*a* that, with the drive unit activated, the unit 5 and the patient sitting on it may be automatically, continuously, and gradually inclined backwards when moving the unit 5 from a lower position LP to an upper position HP, and vice versa when moving it in the other direction. Accordingly, the back 7 of the chair may preferably have a curvature corresponding to the curvature of the stand 4.

The chassis 2 may be designed for stability, so that the patient chair 1 does not overturn with the patient sitting in it and being moved up and down. The convexity of the stand 4 may be directed forward, and the stand 4 may be fixed to the rear portion of the frame 3.

It should be understood that the upper and lower positions HP, LP may not be permanent, but can be selected, for instance, with regard to a comfortable working posture of the carer (tall or short carer), the patient's comfort (the patient enduring a more or less pronounced backward/forward inclination), and/or the measure that is to be taken on the patient.

Figure 2B:
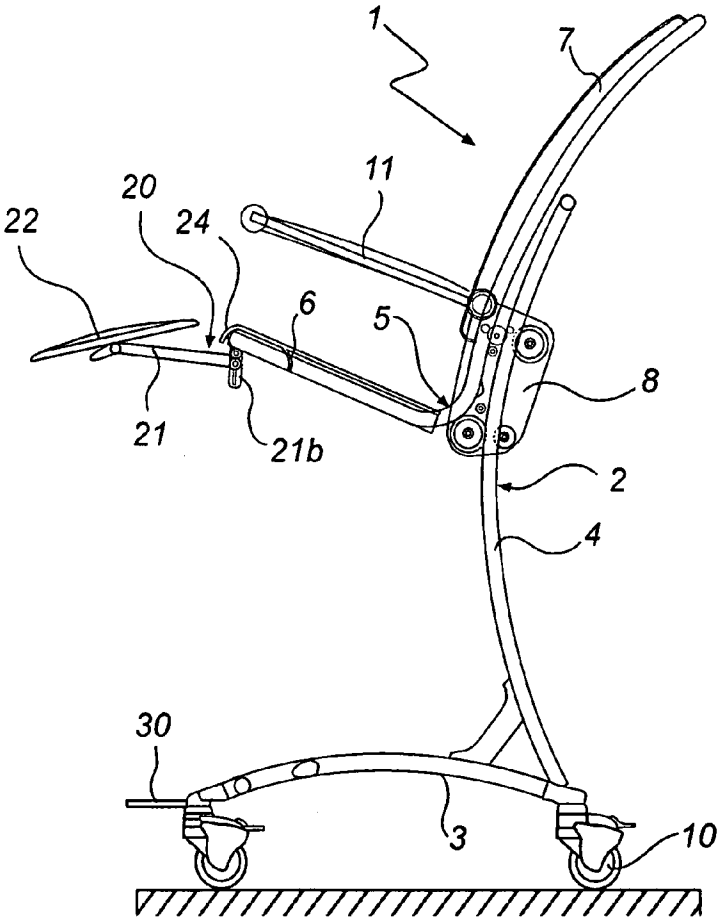
FIGS. 2*a* and 2*b* illustrate side views of another embodiment of the invention having a different driving device.
Figure 2A:
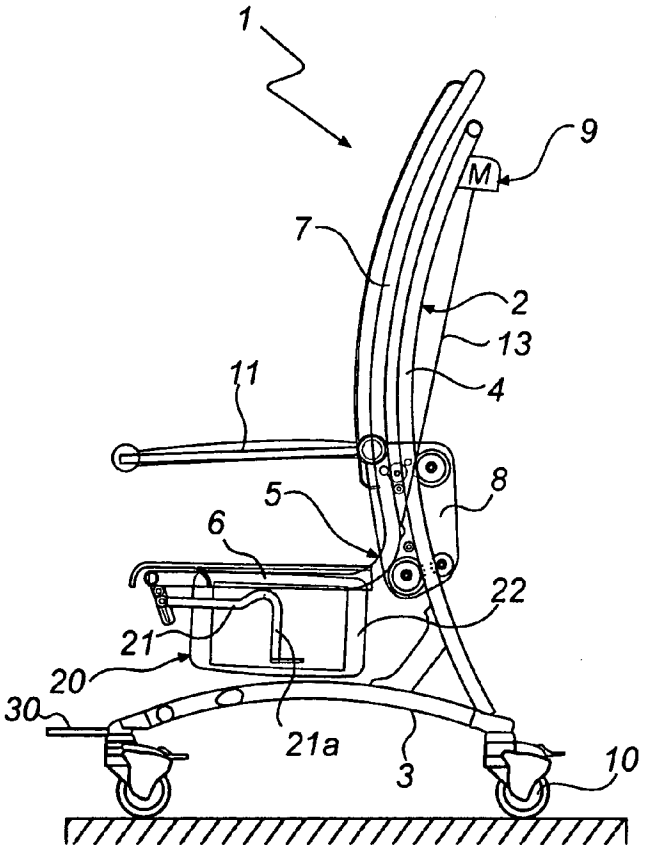

The roller bearing arrangement 8 is shown in more detail in FIGS. 2*a* and 2*b*. The hydraulic assembly 9 is shown in FIG. 2*a*.

Figure 3:
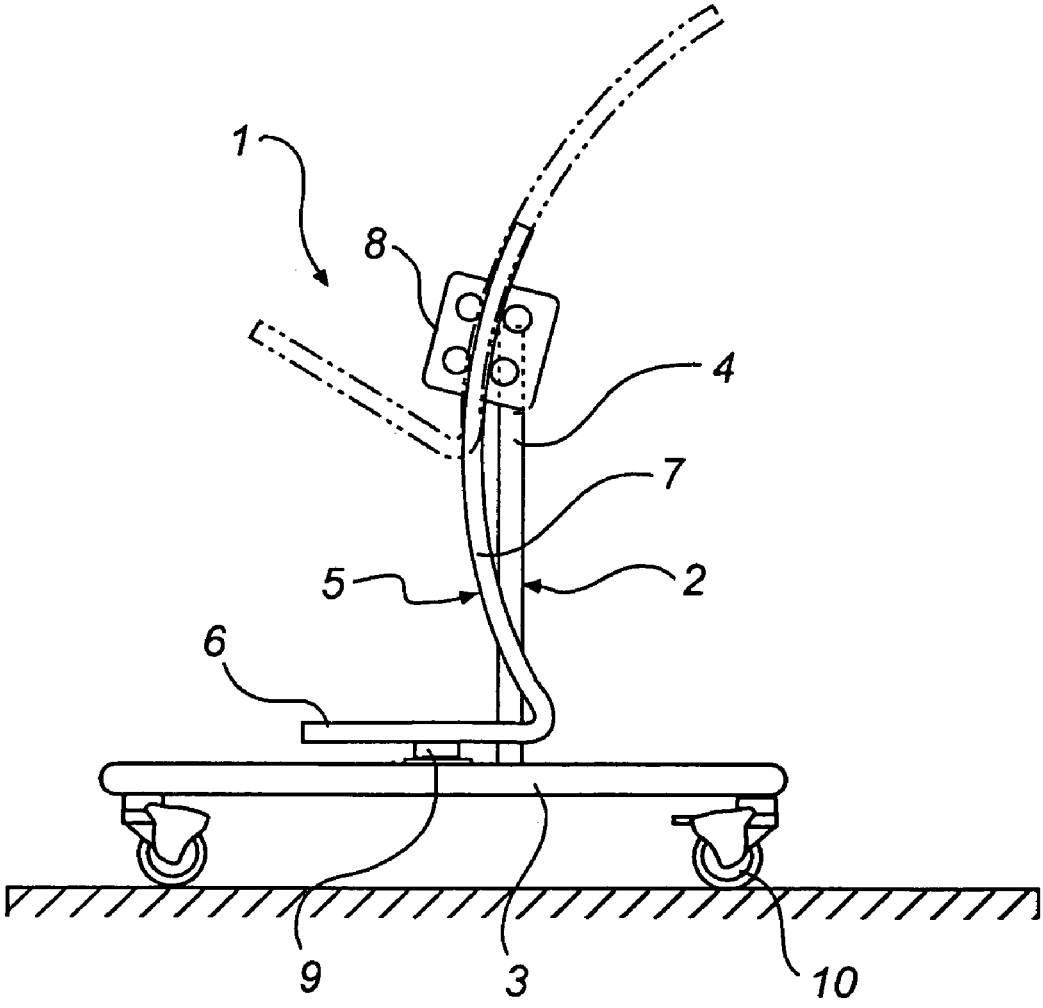
FIG. 3 shows another embodiment of the invention.

In FIG. 3, the stand 4 of the patient chair 1 is straight, and the back 7 of the unit 5 is arched. A roller bearing arrangement 8 may be mounted on the stand 4 and the back 7 of the patient chair 1 to guide the unit 5 in the arcuate path given by the curvature of the back 7 and may be extended between upper and lower positions. A drive unit, for instance a hydraulic cylinder assembly 9, mounted on the chassis 2 under the seat 6, may be arranged to move the unit 5 between upper and lower positions.

The chassis 2 may preferably include wheels 10 on the frame 3, thus allowing the patient chair 1 to be wheeled. Armrests 11 and pivotable footrests 30 may also be included.

It is contemplated that the unit 5 can be moved on the stand 4 by many different driving devices. For instance, a winch may connect the unit 5 to the stand 4 or roller bearing 8, and may be manually operated by a crank. It is also contemplated that instead of a roller bearing 8, a gear arrangement can be used. Of course, an electric motor may also be used. Thus, it should be apparent that any suitable arrangement, of which there are many, for relative movement of the unit 5 and the stand 4, by motor power or manually, may be used. In case of movement by motor power, (remote) control units can be used to stop, accelerate, and retard the movement.

The shown upside-down U-shape of the stand 4 may not be necessary. For example, the stand 4 may consist of a single upright if the chassis 2 is designed with corresponding stability, to support the patient. Additionally or alternatively, the stand 4 may constitute the back 7 of the patient chair 1, and only the seat 6 can be moved relative to the back 7.

The frame 3 may be suitably designed so as to allow the patient chair 1 to be pushed under a bed, or around a toilet. For use with a toilet, the seat 6 may have an opening 12.

Furthermore, the patient chair 1 can also be provided with various usual leg rests, armrests and headrests, which can be adjustable.

FIGS. 2*a* and 2*b* show another embodiment of patient chair 1, provided with an advantageous calf rest structure 20. The advantage may reside in the fact that the calf rest structure may take up a small space in the inactive moved-away position (FIG. 2*a*), which may be used, for instance, while a patient is made to sit in the patient chair 1, when transporting or storing the patient chair 1 without a patient, or when transporting a patient in the patient chair 1 in narrow spaces, such as, for example, lifts and narrow bathrooms/lavatories. The calf rest structure 20 may comprise a mounting arm 21, on which a plate-shaped calf rest pad 22 may be tiltably mounted by means of a transverse arm part 21*a* at one end of the arm 21. The other end of the mounting arm 21 may be articulated to the underside of the seat 6 by means of a hinge. The hinge may comprise a sleeve 21*b* at the other end of the mounting arm 21, in which a pin 24 may engage, which may be fixed to the underside of the seat 6, close to the front edge thereof and the corner of the seat. The hinge 21*b* may be inclined on the seat underside in such a manner that the mounting arm 21 and the calf rest pad 22, when pivoting from the inactive position to the active position in FIG. 2*b*, may describe a part-circular sweeping motion in the course of which the calf rest pad 22 may be moved behind the leg of a patient sitting in the patient chair 1. The carer may possibly have to first lift the leg somewhat. This pattern of movements for the calf rest 20 may facilitate the carer's work when the patient's leg is to be put on the pad 22, especially if the seat 6 is in the raised position. As shown in FIG. 2*b*, the calf rest pad 22 may extend in the active position straight away from the patient chair 1. The active and inactive positions may be end positions, defined by a slot-lug connection in the sleeve 21*b* and the pin 24.

Moreover, FIGS. 2*a* and 2*b* illustrate an electric motor winch 9 for the unit 5. The electric motor winch 9 may include a motor M being fixed to the upper part of the stand 4. The motor M, by means of a band 13, may pull and release, respectively, the unit 5 for movement between the lower and upper positions.

The invention claimed is:

1. A patient chair comprising:

a chassis comprising a frame, a seating device intended for the patient and connected to the chassis, a driving device that moves the seating device relative to the frame along a course of curved movement in the vertical direction between a lower and an upper position, wherein in the upper position, the seating device, and a patient sitting in the seating device, are inclined backwards relative to the lower position, a stand which belongs to the chassis and extends upwards from the frame, an element which is connected to the stand and which is continuously arched, and means positioned on the stand and the seating device that guides the seating device along the element in the movement of the seating device between the lower and upper positions, so that the seating device is continuously gradually tilted in the course of its curved movement in the vertical direction.

2. A patient chair according to claim 1, wherein the stand itself constitutes the element.

3. A patient chair in according to claim 1 wherein the seating device includes a seat of a chair and a back of a chair, which form a unit.

4. A patient chair according to claim 1, wherein the means for guiding the seating device consists of a back of a chair.

5. A patient chair according to claim 1 wherein the element constitutes the stand and includes a back of a chair, and the seating device consists of a seat of a chair.

6. A patient chair according to claim 1, wherein the driving device is a manual, hand-operated winch.

7. A patient chair according to claim 6, wherein the driving device has a pulling effect on the seating device.

8. A patient chair according to claim 6, wherein the driving device has a pushing effect on the seating device.

9. A patient chair according to claim 1, wherein the driving device is an electric motor or a hydraulic assembly.

10. A patient chair according to claim 1, wherein the guide means comprise a roller bearing arrangement.

11. A patient chair according to claim 1, wherein at least one plate-shaped calf rest with a calf rest pad is mounted on the patient chair, and wherein the calf rest is arranged by means of a joint arrangement to be pivotable between an inactive end position where the extent of the calf rest pad is essentially parallel to one side of the patient chair and the calf rest pad is located close to the patient chair, and an active end position, where the calf rest pad is capable of supporting the patient's leg when extended, away from the patient chair.

12. A patient chair including:

a. a frame, b. a seat intended for the patient, the seat being movable relative to the frame in the vertical direction between a lower and an upper position, wherein:

(1) in the lower position, the seat is oriented at least substantially horizontally, and (2) in the upper position, the seat is inclined backwards relative to the lower position, c. a stand extending upwardly with respect to the frame, the stand being situated behind the seat, wherein:

(1) the stand is arched, and (2) the seat moves between the lower and upper positions along a path defined by the stand.

13. The patient chair of claim 12 wherein:

a. the seat includes a seat back extending upwardly therefrom; and b. the stand is situated behind the seat back.

14. The patient chair of claim 12 wherein the stand defines a track along which the seat travels.

15. The patient chair of claim 14 wherein rollers are interposed between the seat and the stand, with the rollers riding along the stand.

16. The patient chair of claim 12 wherein the stand arches upwardly with respect to the frame and rearwardly with respect to the seat.

17. A patient chair including:

a. a frame defining a chair base, the frame bearing wheels whereby the patient chair is transportable on the base;

b. a seat intended for the patient, e. a stand extending upwardly with respect to the frame, the stand being situated behind the seat;

d. a bearing engaged between the seat and the stand, wherein the bearing engages at least one of the seat and the stand to allow movement of the seat with respect to the stand, with such movement being between:

(1) a lower seat position wherein the seat is oriented at least substantially horizontally, and (2) an upper seat position above the lower position, wherein the seat is inclined upwardly as it extends away from the stand.

18. The patient chair of claim 17 wherein the seat travels along an arcuate path between the lower seat position and the upper seat position.

19. The patient chair of claim 17 wherein the stand:

a. is arched, and b. defines an arcuate path along which the bearing travels.

20. The patient chair of claim 17 wherein:

a. the seat has a rear seat back extending upwardly therefrom, and b. the bearing is engaged to the seat back.

* * * * *